US005727607A

United States Patent [19]

Ichikawa et al.

[11] Patent Number: 5,727,607

[45] Date of Patent: *Mar. 17, 1998

[54] POWDER FEEDING METHOD AND APPARATUS FOR FEEDING POWDERS WITH A FLUID WITH INCREASED PRECISION

[75] Inventors: Hideo Ichikawa; Sunao Ikeda, both of Numazu; Michiharu Narushima, Shimizu; Nobuhiro Makita, Numazu, all of Japan

[73] Assignee: Ricoh Company, Ltd., Tokyo, Japan

[ * ] Notice: The term of this patent shall not extend beyond the expiration date of Pat. No. 5,711,353.

[21] Appl. No.: 591,375

[22] Filed: Jan. 25, 1996

[30] Foreign Application Priority Data

Jan. 26, 1995 [JP] Japan ..... 7-010901

[51] Int. Cl.[6] ..... B65B 1/08; B65B 1/16; B65B 3/08; B65B 3/10

[52] U.S. Cl. ..... 141/67; 141/69; 141/374; 366/101; 366/107

[58] Field of Search ..... 141/12, 70, 71, 141/73, 74, 83, 67, 69, 286, 374, 114, 315–317, DIG. 1; 366/101, 102, 106, 107

[56] References Cited

U.S. PATENT DOCUMENTS

| | | | |
|---|---|---|---|
| 773,877 | 11/1904 | Lorillard | 141/73 |
| 3,578,041 | 5/1971 | Obara | 141/317 |
| 4,185,669 | 1/1980 | Jevakohoff | 141/286 |
| 4,212,331 | 7/1980 | Benatar | 141/67 |
| 4,325,495 | 4/1982 | Mokris | 366/106 |
| 4,655,237 | 4/1987 | Gloor et al. | 137/13 |

*Primary Examiner*—Henry I. Recla
*Assistant Examiner*—Timothy L. Maust
*Attorney, Agent, or Firm*—Oblon, Spivak, McClelland, Maier & Neustadt, P.C.

[57] ABSTRACT

A powder feeding method includes the steps of injecting a gaseous medium into a powder material held in a hopper from a porous wall forming a funnel at a bottom part of said hopper, such that the injection of the gaseous medium is carried out intermittently.

23 Claims, 10 Drawing Sheets

POWDER FEEDING METHOD AND APPARATUS FOR FEEDING POWDERS WITH A FLUID WITH INCREASED PRECISION

This invention is related to a previously filed application Ser. No. 08/589,003.

BACKGROUND OF THE INVENTION

The present invention generally relates to filling of powder materials such as toners, chemicals, pharmaceuticals, cosmetics, edibles, and the like, in a container. Particularly, the present invention relates to feeding of magnetic powders such as toner powders used in copiers, printers and facsimiles. Further, the present invention relates to feeding of magnetic powders used in magnetic rollers, various magnetic tapes and magnetic cards, magnetic paints and magnetic fluids.

Filling of powders in a container is a very common process in human society, and a wide variety of methods and apparatuses are known for this purpose. Such powder materials include various chemicals, pharmaceuticals, cosmetics, edibles, and the like, as well as various magnetic powders such as magnetic toners used commonly in copiers, printers and facsimiles. Further, such magnetic powders include those used in magnetic rollers, various magnetic tapes and magnetic cards including magnetic tickets and passes, magnetic paints and magnetic fluids.

FIG. 1 shows a typical example of an apparatus or machine used for feeding a predetermined amount of powder in containers successively one after another.

Referring to FIG. 1, the feeding machine is supplied with a number of containers 10 successively one by one and fills therein a powder material with a predetermined amount. The container 10 may be a toner cartridge of copiers and printers, a plastic or glass bottle of cosmetics, pharmaceuticals and edibles, a case of powder raw materials, or even a flexible bag of plastic. The container 10 is supplied one by one to the feeding machine by a conveyer mechanism 31.

The machine itself includes a hopper 29 for holding the powder material, and the powder material in the hopper 29 is supplied first to a funnel 30 disposed below the hopper 29 by an auger screw 28 provided in the hopper 29, wherein the funnel 30 supplies the powder material further to the container 10 located immediately below an outlet of the funnel 30, with a predetermined, controlled amount. In the hopper 29, the powder is supplied to the funnel 30 through a conduit formed at the bottom of the hopper 29.

In such a powder feeding machine, it is possible to supply the powder material with a predetermined, controlled amount or rate by activating the auger screw 28. In order to control the rate of supply of the powder material such that the container 10 is filled by the powder material with a predetermined amount, the weight of the container 10 is measured before and after the filling step, and a controller 32 calculates the net weight of the powder material in the container 10 by subtracting the weight of the container 10 before the filling step from the weight after the filling step. Based upon the net weight thus obtained, the controller 32 controls the auger screw 28. When the net weight of the powder material in a container 10 exceeds above or falls below a tolerable margin, the controller 32 rejects the container 10 as being a defective product.

In the powder feeding machine of FIG. 1, there has been a problem in that the powder particles tend to block the feed path by engaging with each other when being fed by the auger screw 28. When this occurs, the fluidity of the power material is reduced significantly due to the friction at the powder surface, and efficient supply of the powder material is no longer possible. Further, such a poor fluidity of the powder material results in a poor accuracy in controlling the amount of the power material to be filled in the container 10. Further, the auger screw 28 tends to cause a consolidation of the powder material into the form of flakes. This problem is particularly serious when supplying toner powders.

In order to eliminate such a problem of blocking of the powder feed path, the Japanese Laid-open Patent Publication 4-87903 describes a powder feeding machine that uses a stop valve connected to an air supply pump and an air suction pump. In operation, the stop valve controls the feeding of the powder material by controlling the air pressure applied to the powder material. By applying a negative air pressure to the powders via a suitable filter, the powders are sucked and block the powder feed path. When a positive air pressure is applied subsequently, the blockade is broken and the individual powder particles are supplied with a control amount determined by the air pressure. Thereby, the efficiency of feeding the powders is improved substantially.

On the other hand, such a conventional apparatus still has a problem of poor accuracy in controlling the amount of the powders fed to the containers. During the transport of the powders, the bulk density of the powder material change widely, particularly at the time of applying negative and positive pressure, and the problem of the powder particles blocking the passage of the powder material, including the formation of flakes, tends to occur.

SUMMARY OF THE INVENTION

Accordingly, it is a general object of the present invention to provide a novel and useful method and apparatus for feeding a powder material into a container wherein the foregoing problems are eliminated.

Another and more specific object of the present invention is to provide a method and apparatus for feeding a powder material into a container with improved accuracy.

Another object of the present invention is to provide a method and apparatus for feeding a powder material into a container while maintaining a bulk density of said powder material generally constant during transport of said powder material, by injecting a fluid into said powder material.

Another object of the present invention is to provide a method for feeding a powder material into a container with a predetermined, controlled amount, comprising the steps of:

injecting a gaseous medium into a powder material held in a hopper having a bottom outlet hole, for ejecting said powder material therefrom into a container together with said gaseous medium;

said step of injecting said gaseous medium comprises the step of injecting said gaseous medium through a porous wall of a funnel provided at a bottom part of said hopper.

Another object of the present invention is to provide a method for feeding magnetic toners into a toner cartridge with a predetermined, controlled amount, comprising the steps of:

injecting a gaseous medium into toners held in a hopper having a bottom outlet hole, for ejecting said toners therefrom into a toner cartridge together with said gaseous medium;

said step of injecting said gaseous medium comprises the step of injecting said gaseous medium through a porous wall of a funnel provided at a bottom part of said hopper; and controlling a flowrate of said toners supplied to said toner cartridge through said outlet hole;

wherein said controlling step includes a step for energizing a magnet in said hopper in the vicinity of said outlet hole.

Another object of the present invention is to provide an apparatus for feeding a powder material into a container with a predetermined, controlled amount, comprising:

a hopper for holding a powder material therein, said hopper having a bottom part forming a funnel, said funnel including a porous wall for injecting a gaseous medium into said powder material therethrough, and an outlet for ejecting said powder material to a container together with said gaseous medium;

a control rod provided in said hopper in alignment with said outlet hole in a manner movable in a vertical, axial direction thereof, said control rod controlling a flowrate of said powder material through said outlet hole; and a supplying system for supplying said gaseous medium into said porous wall;

said supplying system including a controller for controlling a supply of said gaseous medium such that said gaseous medium is injected intermittently, while filling said container, with a pause intervening between a gaseous medium injection and a next gaseous medium injection.

According to the present invention, a film of fluid is formed at a grain boundary of the powder particles in the hopper, and the fluidity of the powder material is substantially improved. As a result of formation of the fluid film between the powder particles, the bulk density of the powder material is maintained generally constant while the powder material is transported in the hopper to the fluid outlet. By carrying out the injection of the fluid intermittently, the fluidity of the powder material is improved further, and an accurate control of the powder feed rate is achieved. As a result, such a method and apparatus can fill the container with a predetermined, controlled amount.

Other objects and further features of the present invention will become apparent from the following detailed description when read in conjunction with the attached drawings.

DETAILED DESCRIPTION OF THE PREFERRED EMBODIMENTS

Figure 1:
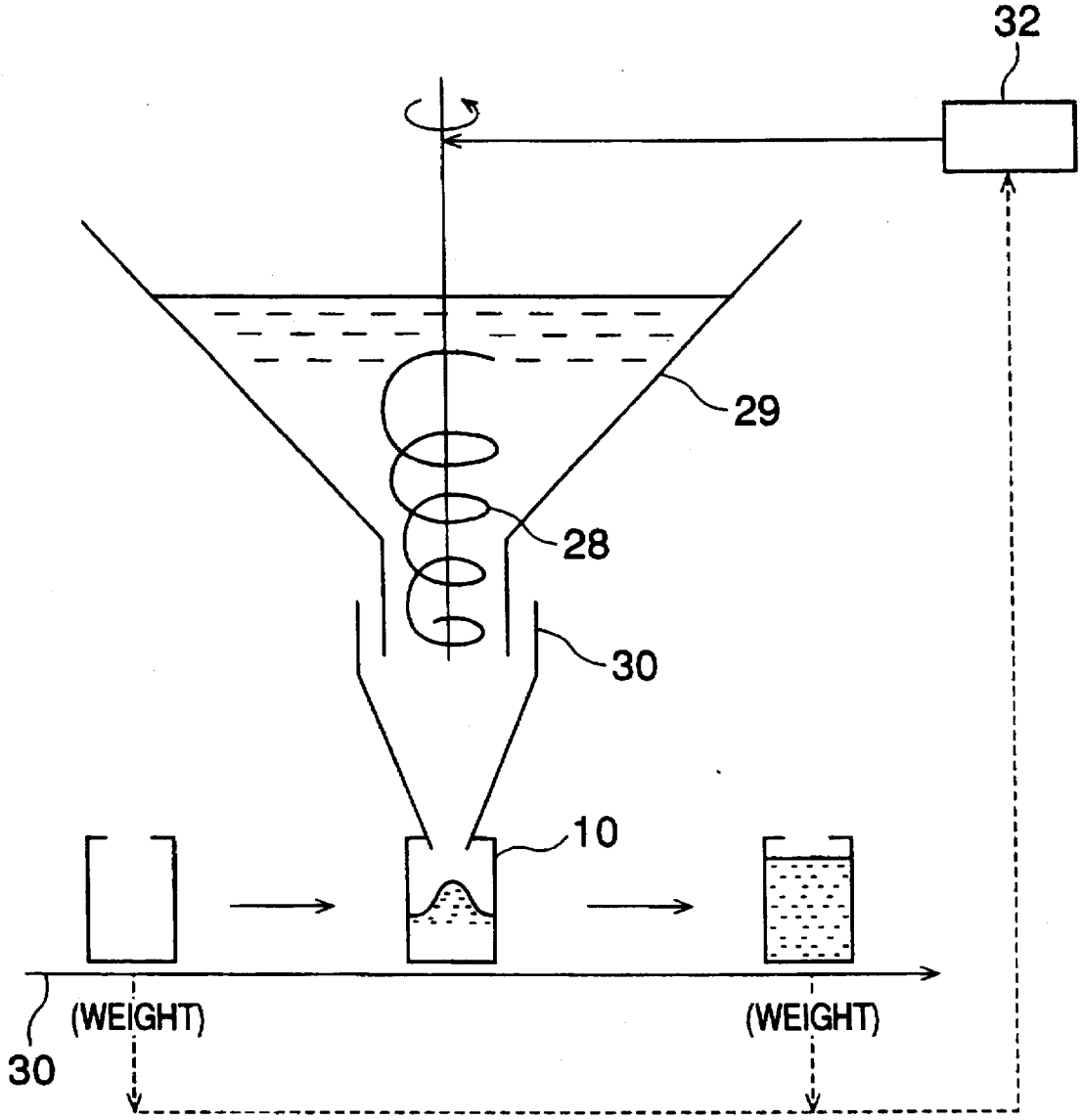
FIG.1 PRIOR ART
FIG. 1 is a diagram showing the construction of a conventional powder feed apparatus.
Figure 2:
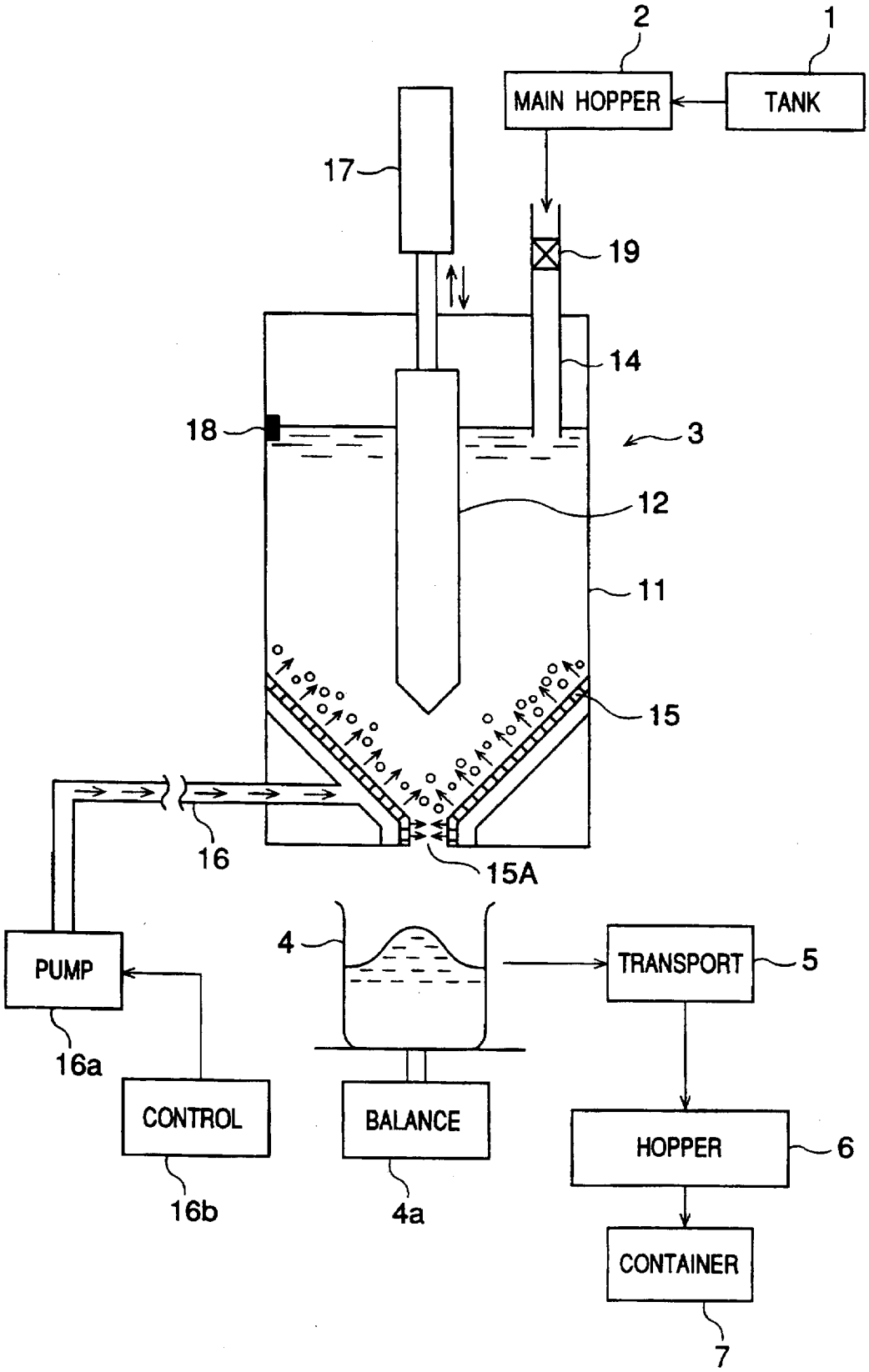
FIG. 2 is a diagram showing the construction of a powder feed apparatus according to a first embodiment of the present invention.

FIG. 2 shows the construction of a powder feed apparatus 3 according to a first embodiment of the present invention, wherein the powder feed apparatus 3 is used in a powder filling system that includes a tank 1 for storing a powder material and a main hopper to which the powder material in the tank 1 is supplied. The powder feed apparatus 3 is thereby supplied with the powder material from the main hopper 2 and feeds the powder material thus supplied to a container 4 held on a balance 4*a* with a controlled rate of feeding.

The container 4 is handled by a transport mechanism 5 such as robot, and the content of the container 4 is moved to a hopper 6 that fills the powder material therein in another container 7 that is used for shipping the powder material. When the amount of the powder material in the container 4 is excessive or insufficient, the lot is discarded and the powder material in the container 4 is returned to the tank 1.

The powder feed apparatus 3 forms a hopper 11 having a funnel 15 at the bottom part thereof, wherein the funnel 15 has an outlet hole 15A aligned with the container 4 held on the balance 4*a* for ejecting the powder material in the hopper 11. Further, the powder material from the main hopper 2 is supplied to the hopper 11 through a conduit 14 under control of a valve 19. In order to maintain the amount of the powder material in the powder feed apparatus 3 at a proper level, the hopper 11 is equipped with a level sensor 18.

In order to facilitate the feeding of the powder material from the hopper 11 to the container 4, the wall of the funnel 15 is formed with a porous material such as a sintered metal or ceramic, and the air is supplied to the funnel 15 from a pump 16*a* under control of a controller 16*b*. The air is thereby injected into the powder material in the hopper 11 and forms an air film at the boundary of the powder particles. Thereby, the fluidity of the powder material is substantially improved in the hopper 11, and an accurate feed control is achieved for the powder material supplied to the container 4 through the outlet 15A.

It should be noted that porous material forming the funnel 15 has a density of 6.6–7.4 g/cc, and may be formed by a sintering of preferably spherical particles of copper, aluminum or ceramic having a diameter of 50–20 μm. As long as the porous material has fine pores of 5–75 μm in the average diameter, preferably in the range 20–50 μm, any material may be used for the funnel 15, provided that the porous material allows passage of the air therethrough. When feeding magnetic powder material such as magnetic toners, it is preferable to form the funnel 15 by a non-magnetic material such as porous ceramics or non-magnetic metals.

In order to control the rate of feeding of the powder material supplied through the outlet 15A, the apparatus of FIG. 2 uses a control rod 12 that is moved up and down by a cylinder 17 as indicated by arrows.

Figure 3:
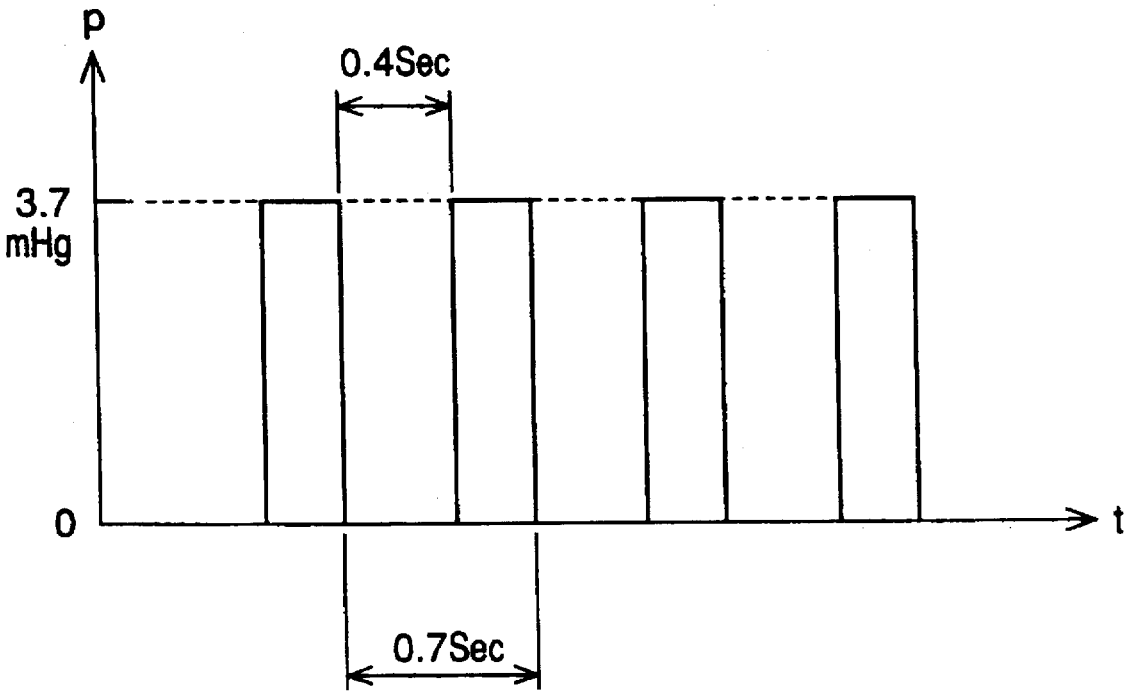
FIG. 3 is a timing chart showing the timing of air pulse supply used in the apparatus of FIG. 2.

In the present embodiment, the injection of the air into the powder material from the porous wall of the funnel 15 is preferably achieved, while filling the same, single container 4, in an intermittent manner with an intervening pause between an injection and a next injection, or by increasing and decreasing the air pressure alternately as indicated in FIG. 3. By doing so, the fluidity of the powder particles in the hopper 11 is further increased, and the accuracy of control of the feed rate of the powder material into the container 4 is improved further. For example, the controller 16*b* controls the pump 16*a* such that the air supply is interrupted for 0.4 seconds in every 0.7 seconds of air injection. Alternately, the air pressure may be changed alternately and repeatedly between 0 mHg and 3.7 mHg.

Figure 4:
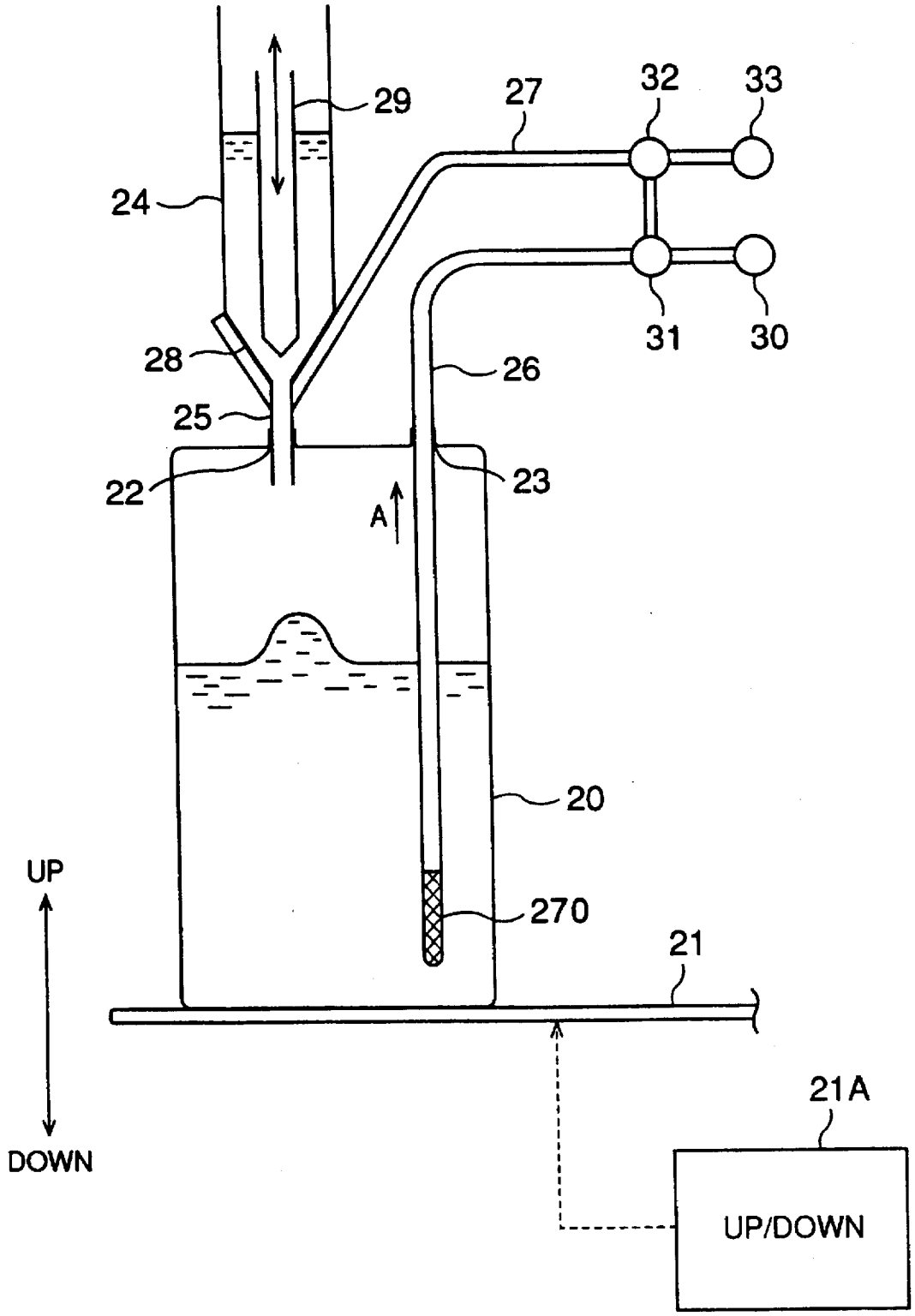
FIG. 4 is a diagram showing a second embodiment of the powder feed apparatus in detail.

FIG. 4 shows a powder feeding apparatus according to a second embodiment of the present invention, wherein the powder feeding apparatus of FIG. 4 is used to produce a product such as a toner cartridge filled with toners.

Referring to FIG. 4, the powder feeding apparatus includes a hopper 24 holding a powder material therein, wherein the hopper 24 is formed with a funnel 28 at a bottom part thereof similarly to the hopper 11 of FIG. 2. Therefore, the control rod 29 operates similarly as does the control rod of the first embodiment. Thus, the funnel 28 is formed of a porous material similar to the material forming the funnel 15 and is supplied with a compressed air from a pump 33 via a conduit 27 under control of a valve 32. The air thus supplied to the funnel 28 is injected into the powder material in the hopper 24 similarly to the powder feeding apparatus of FIG. 2.

In the present embodiment, the powder material is ejected from the funnel 28 through an outlet 25 into a container 20 held on a stage 21 that is movable up and down by a lifting mechanism 21A as indicated by arrows in FIG. 4. Thereby, the container 20 forms an air-tight enclosure except for an opening 22 and an opening 23, wherein the outlet 25 of the funnel 28 is inserted into the opening 22 when the stage 21 is lifted in the upward direction by the lift mechanism 21A toward the powder feeding apparatus. Thereby, the opening 22 forms an air-tight gasket with respect to the outlet 25.

Further, there is provided a suction rod 26 adjacent to the powder feed apparatus, such that the suction rod 26 is inserted into the container 20 through the opening 23, wherein the suction rod 26 has an end connected to a suction pump 30 via a valve 31. The other end of the rod 26 is provided with a mesh filter 270 that allows suction of the air from the powder material accumulated in the container 20. Thereby, the opening 23 forms a gasket with the suction rod 26. When the stage 21 is lowered, the suction rod 26 is disengaged from the container 20. It should be noted the various other filters such as a porous metal filter formed of sintered metal particles, a paper filter, a cloth filter, a non-woven fabric filter, and the like may be used for the filter 270. Typically, the openings 22 and 23 are formed to have a diameter of 6 mm or less, preferably 5 mm or less for reducing the size of the container 20, when the container 20 is a toner cartridge.

In operation, the pump 33 supplies the compressed air to the funnel 28 via the valve 32 for injection into the powder material in the hopper 24, and the powder material in the hopper 24 is caused to flow into the container 20 through the outlet 25 with increased fluidity. Simultaneously, the suction pump 30 is activated, and the air in the powder material accumulated in the container 20 is removed via the valve 31. By evacuating the air from the air-tight container 20, it is possible to increase the rate and hence the efficiency of powder feeding.

The powder material thus accumulated in the container 20 while evacuating the air therefrom, generally shows an increased bulk density as compared with the powder material deposited by a natural falling process. In order to avoid excessive increase of the powder bulk density, which may lead to a solidification of the powder material by the bridging of the powder particles, the pump 30 or the valve 31 is controlled such that the air is pumped out from the container 20 with a negative pressure of −600—50 mmHg, preferably in the range of −250—150 mmHg. Further, in order to avoid solidification of the powder material at the bottom part of the container 20, the suction rod 26 may be pulled up gradually as indicated in FIG. 4 by an arrow A, with the deposition of the powder material in the container 20, such that the suction of the air occurs only at the surface part of the powder material accumulated in the container 20. Thereby, powder material is obtained in the container 20 with a bulk density corresponding to the bulk density of the powder material deposited by a natural process.

When the powder feeding apparatus of FIG. 4 is used for filling iron-base toners, it is possible to increase the weight of the toner per unit volume to 0.7–0.8 g/ml by applying the air suction. Thereby, the amount of the toners that can be filled in a toner cartridge increases without causing problem. This indicates that one can reduce the size of the toner cartridge or increase the duration that a copier or a printer can be used without replacing the toner cartridge.

Further, it is possible to apply the negative pressure to the container 20 intermittently, with a pause intervening between a suction and a next suction. Further, it is possible to open the valves 31 and 32 alternately, such that the injection of the air into the powder material in the hopper 24 and the suction of the air from the powder material in the container 20 occurs alternately. In this case, both the injection of the air into the hopper 24 and the suction of the air from the container 20 occur intermittently.

After the filling of the toners into the container 20 is thus completed, the lift mechanism 21A is activated and the stage 21 is lowered. As a result, the outlet 25 as well as the suction rod 26 are disengaged from the respective openings 22 and 23, and the openings 22 and 23 are closed. When disengaging the outlet 25 and the suction rod 26 from the container 20, it should be noted that the problem of toner spillage does not occur, as the filter 270 has a diameter substantially identical to the diameter of the suction rod 26.

In the apparatus of FIG. 4, it should be noted that the valves 31 and 32 may be set to as to supply the compressed air from the pump 33 to the filter 270, in the event the powder material in the container 20 have caused a solidification at the filter 270. By doing so, bridging of the powder particles or any clogging of the filter is successfully eliminated.

Figure 5:
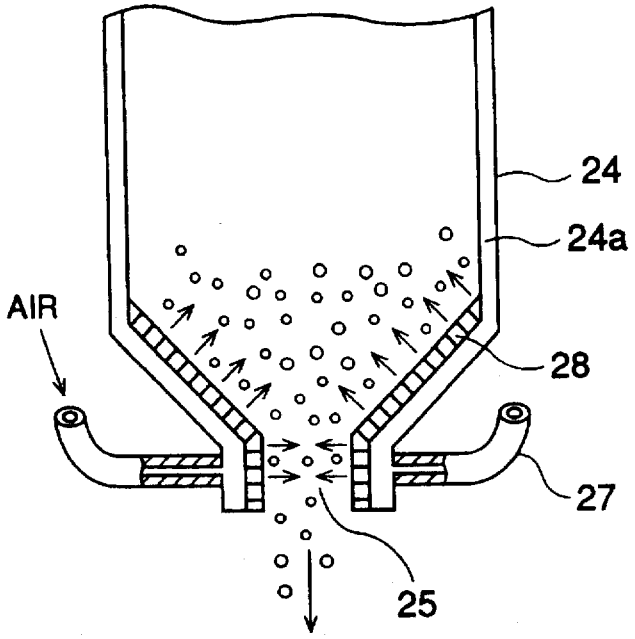
FIG. 5 is a diagram showing a part of the powder feed apparatus of FIG. 4 in detail.

FIG. 5 shows the details of the funnel 28 of the apparatus of FIG. 4.

Referring to FIG. 5, it will be noted that the compressed air from the pump 33 is supplied to a space **24*a* formed between the porous funnel 28 and the outer wall of the hopper 24 via the conduit 27 from two directions, and penetrates therefrom further into the porous funnel 28**.

Figure 6:
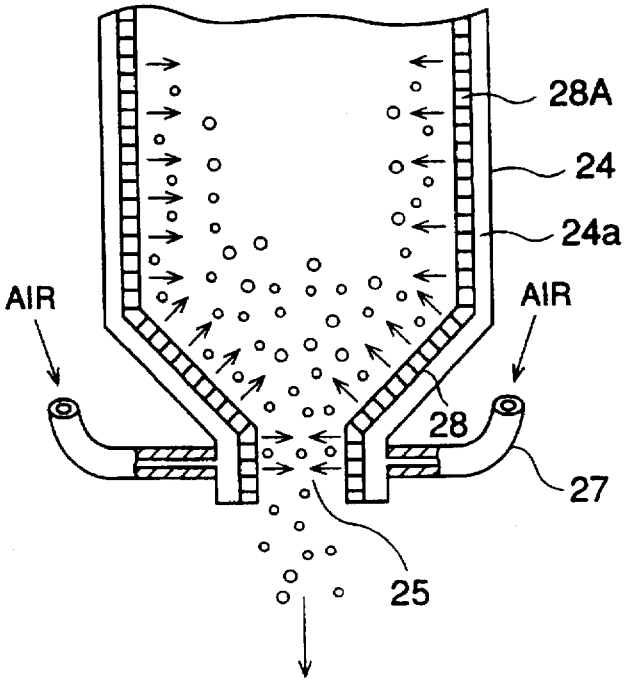
FIG. 6 is a diagram similar to FIG. 5 showing a modification of the powder feed apparatus of FIG. 4.

FIG. 6 shows a modification of the hopper of FIG. 5.

Referring to FIG. 6, the porous wall forming the funnel 28 is now extended in the upward direction to cover the inner side wall of the hopper 24. Thereby, the compressed air is also injected into the powder material in the hopper 24 also from the porous part 28A forming the inner side wall.

It should be noted that the powder feeding apparatus of the present invention is applicable to various powder materials including non-magnetic powder material such as pharmaceuticals, cosmetics, edibles, and the like, as well as to magnetic powder material such as toners or other magnetic powders. When the powder material is susceptible to oxidation, it is possible to inject other gases or fluids such as nitrogen or argon, into the powder material held in the hopper 11 in place of the air. Further, it is possible to control the temperature of the gases and fluids used in the powder feeding apparatus as desired.

Figure 7:
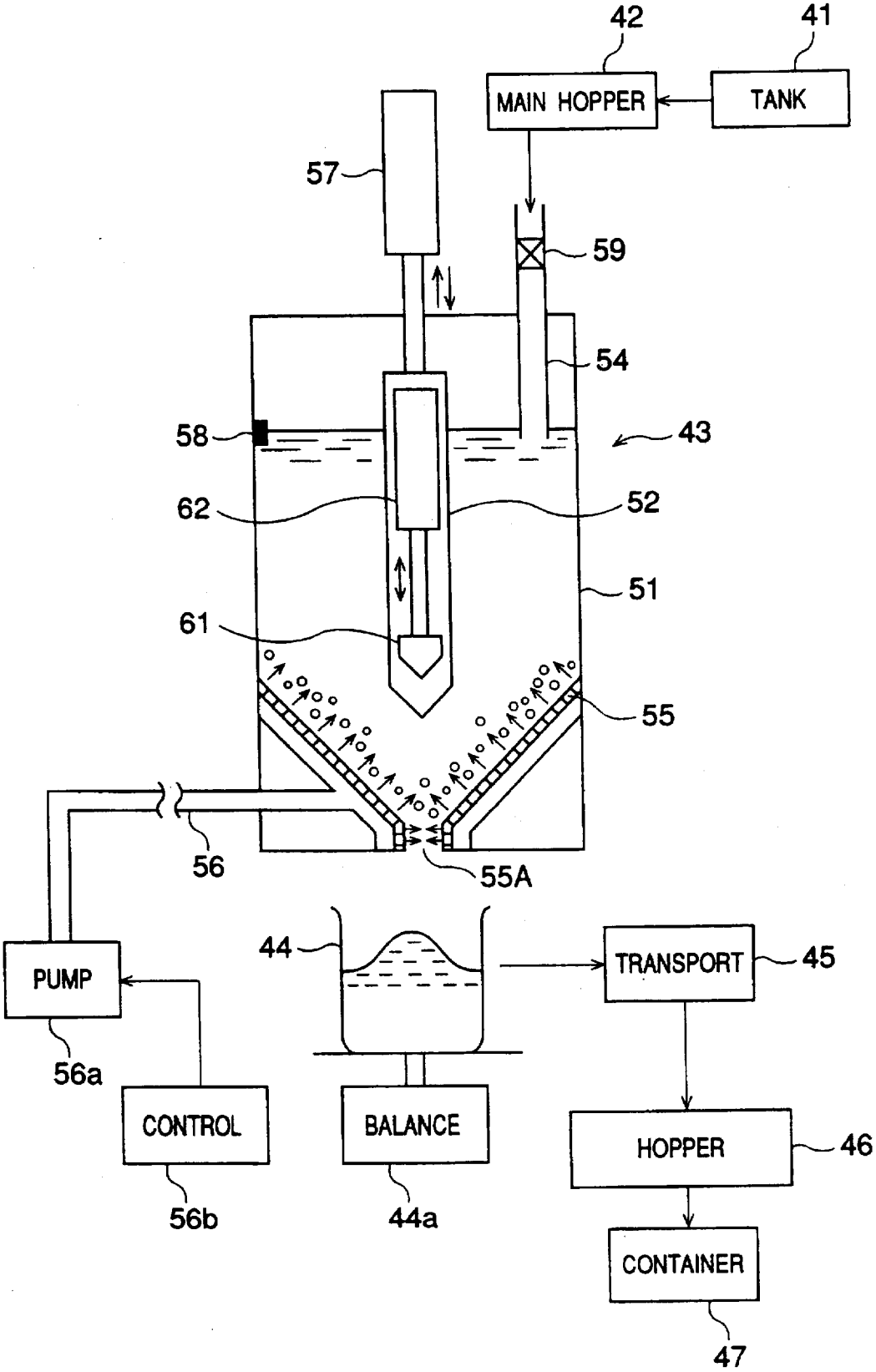
FIG. 7 is a diagram showing the construction of a powder feed apparatus according to a third embodiment of the present invention.

Hereinafter, a powder feeding apparatus according to a third embodiment of the present invention will be described with reference to FIG. 7 showing a toner feeding apparatus 43 used for feeding magnetic toners.

Referring to FIG. 7, the toner feed apparatus 43 is used in a toner filling system that includes a storage tank 41 for storing magnetic toners and a main hopper 42 to which the toners in the tank 41 is supplied. The toner feed apparatus 43 is thereby supplied with the magnetic toners from the main hopper 42 and feeds the toners thus supplied to a container 44 held on a balance 44*a* with a controlled rate of feeding.

The container 44 is moved or handled by a transport mechanism 45 such as robot, and the content of the container 44 is moved to a hopper 46 that fills the magnetic toners therein in another container 47 that may be an empty toner cartridge. When the amount of the magnetic toners in the container 44 is excessive or insufficient, the lot is discarded and the magnetic toners in the container 44 are returned to the tank 41.

The toner feed apparatus 43 forms a hopper 51 having a funnel 55 at the bottom part thereof, wherein the funnel 55 has a toner outlet hole 55A aligned with the container 44 held on the balance 44*a* for ejecting the toners in the hopper 51. Further, the toners from the main hopper 42 is supplied to the hopper 51 through a conduit 54 under control of a valve 59. In order to maintain the amount of the magnetic toners in the toner feed apparatus 43 at a proper level, the hopper 51 is equipped with a level sensor 58.

In order to facilitate the feeding of the magnetic toners from the hopper 51 to the container 44, the wall of the funnel 55 is formed with a porous material such as a sintered metal or ceramic, and the air is supplied to the funnel 55 from a pump 56*a* under control of a controller 56*b*. The air is thereby injected into the magnetic toners in the hopper 51 and forms an air film at the boundary of the magnetic toner particles. Thereby, the fluidity of the magnetic toners is substantially improved in the hopper 51, and an accurate feed control is achieved for the magnetic toners supplied to the container 44 through the toner outlet 55A.

It should be noted that porous material forming the funnel 55 has a density of 6.6–7.4 g/cc similarly to the funnel 15, and may be formed by a sintering of preferably spherical particles of copper, aluminum or ceramic having a diameter of 50–20 μm. As long as the porous material has fine pores of 5–75 μm in terms of average diameter, preferably in the range 20–50 μm, any material may be used for the funnel 55, provided that the porous material allows passage of the air therethrough.

Figure 8:
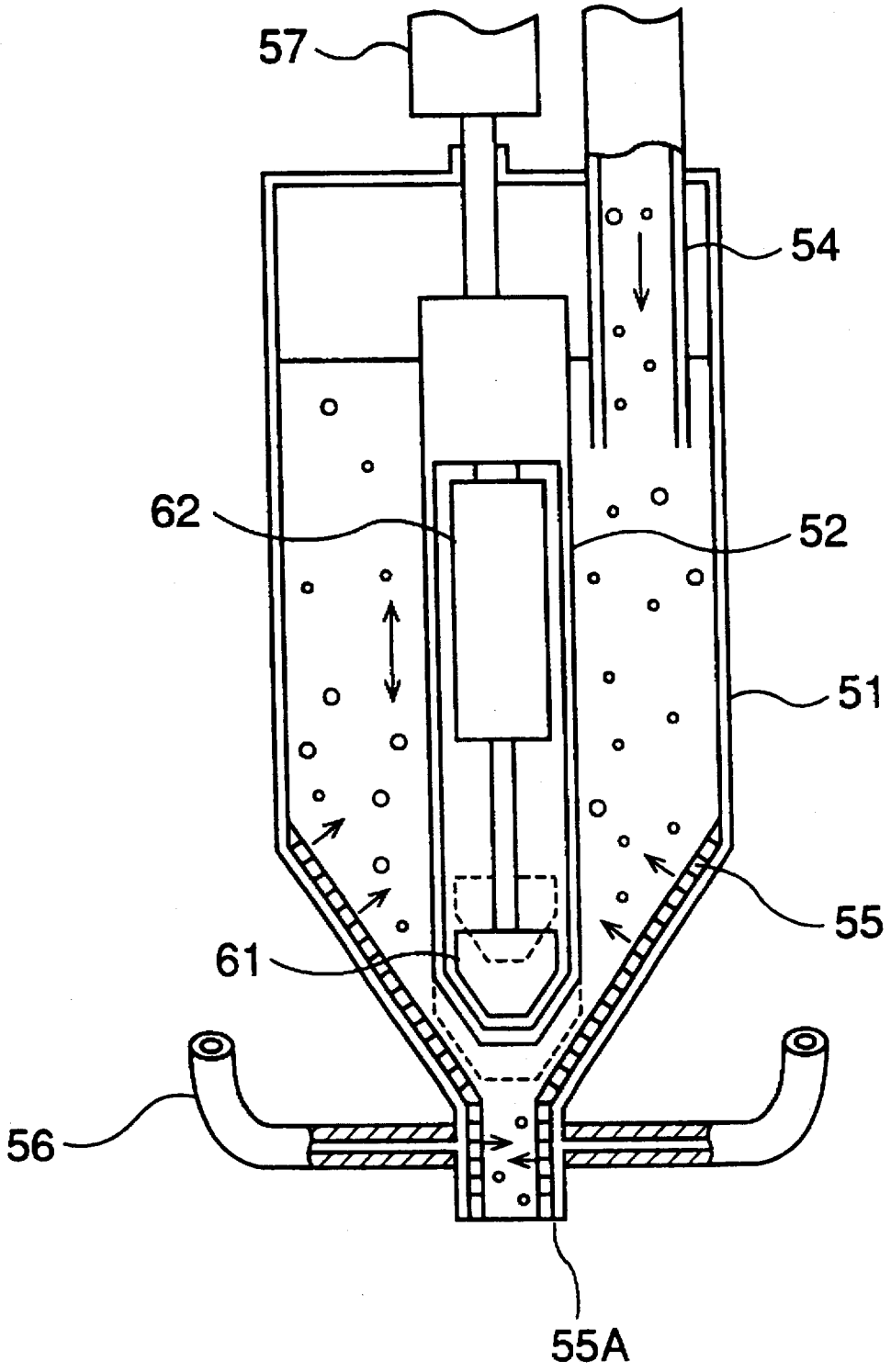
FIG. 8 is a diagram showing a part of the powder feed apparatus of FIG. 7 in detail.

In order to control the rate of feeding of the magnetic toners supplied through the outlet 55A, the apparatus of FIG. 7 uses a control rod 52 that includes a magnet 61 therein such that the magnet 61 is moved up and down by a cylinder 62 as indicated by arrows. Further, the control rod 52 itself is moved up and down by a cylinder 57. See FIG. 8 showing the details of the control rod 52. By activating the cylinder 57, it is possible to achieve a coarse control of the toner feed rate through the toner outlet 55A, while a fine control of the toner feed rate is achieved by activating the cylinder 62.

As indicated in FIG. 8 by a broken line, the control rod 52 does not engage with the funnel 55 at the bottom part of the hopper 51 even when in the fully lowered state. Thereby, the problem of the magnetic toners being crushed into flakes as a result of engagement of the control rod 52 and the funnel 55 is successfully eliminated. It should be noted that the magnetic toners are attracted to the tip end of the control rod 52 by the magnetic attraction of the magnet 61. Thereby, the problems such as the magnetic toner particles forming flakes as a result of mechanical engagement between the control rod 52 and the funnel 55 is successfully eliminated.

In the present embodiment, the injection of the air into the magnetic toners from the porous wall of the funnel 55 is preferably achieved, while filling the same, single container 44, in an intermittent manner with an intervening pause between an injection and a next injection, or by increasing and decreasing the air pressure alternately. By doing so, the fluidity of the toner particles in the hopper 51 is further increased, and the accuracy of control of the feed rate of the toners into the container 44 is improved further. For example, the controller 56*b* controls the pump 56*a* such that the air supply is interrupted for 0.4 seconds in every 0.7 seconds of air injection. Alternately, the air pressure may be changed alternately and repeatedly between 0 mHg and 3.7 mHg.

Figure 9:
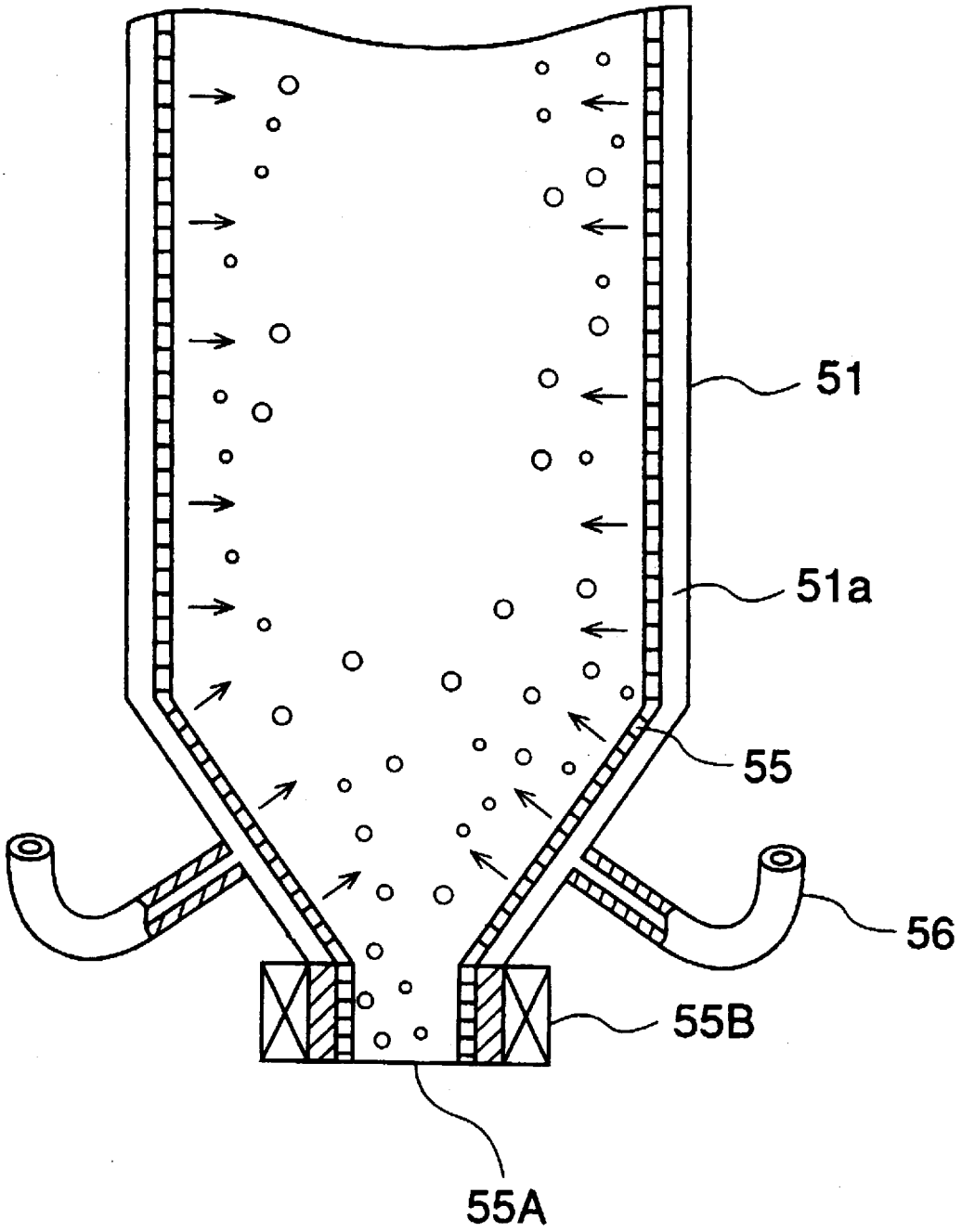
FIG. 9 is a diagram showing a modification of the powder feed apparatus of FIG. 7.

FIG. 9 shows a modification of the toner feeding apparatus of FIGS. 7 and 8.

Referring to FIG. 9, it will be noted that the porous wall is formed not only in the funnel 55 at the bottom part of the hopper 51 but also at the inner side wall of the hopper 51 so as to inject the air laterally. In FIG. 9, it will be noted that the air supplied through the conduit 56 first fills a space 51*a* between the body of the hopper 51 and the porous side wall and is further injected into the toners through the porous side wall.

Figure 10:
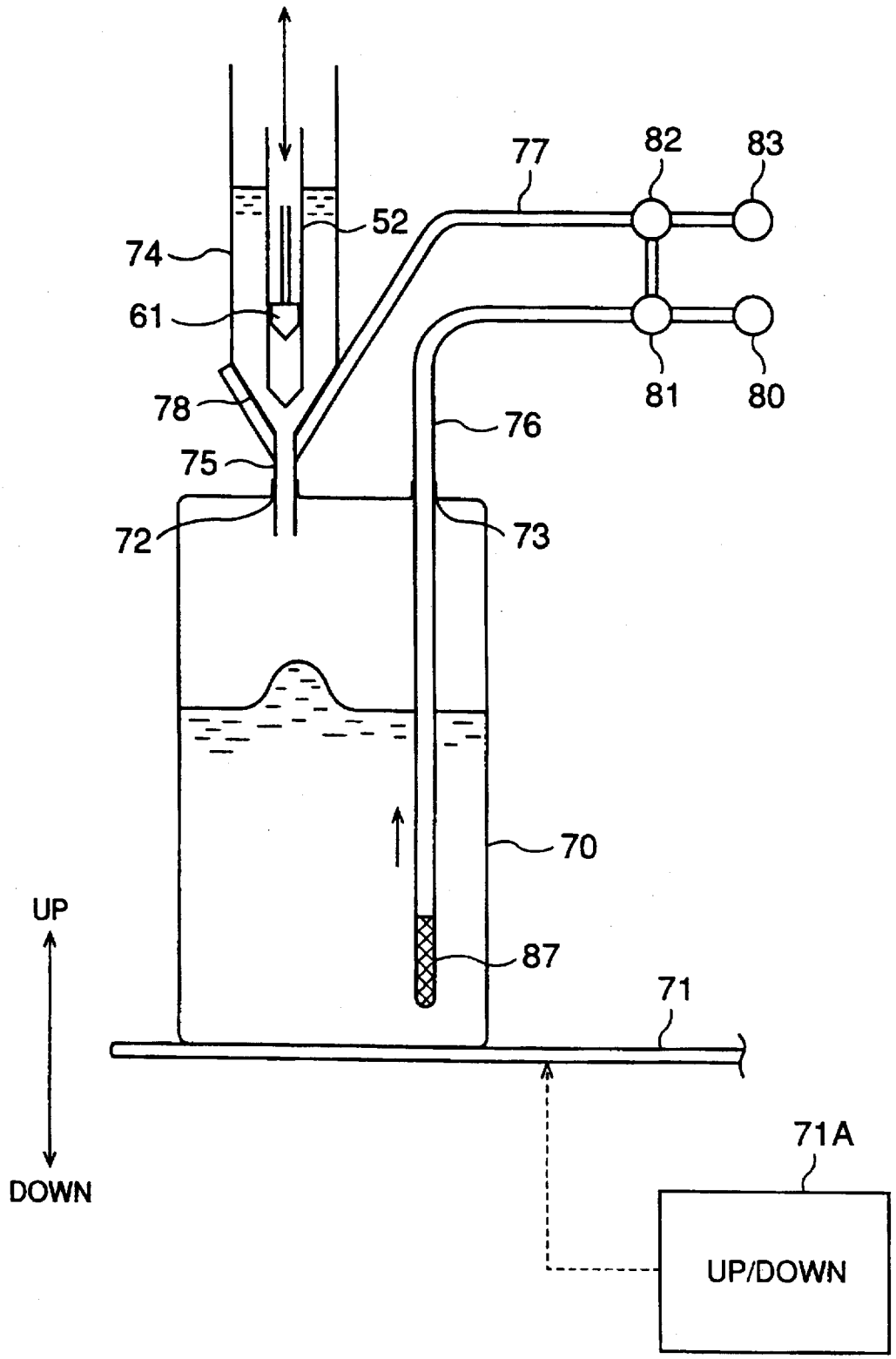
FIG. 10 is a diagram showing a fourth embodiment of the powder feed apparatus.

FIG. 10 shows a toner feeding apparatus according to a fourth embodiment of the present invention, wherein the toner feeding apparatus of FIG. 10 is used to produce a toner cartridge filled with magnetic toners.

Referring to FIG. 10, the toner feeding apparatus includes a hopper 74 holding magnetic toners therein, wherein the hopper 74 is formed with a funnel 78 at a bottom part thereof similarly to the hopper 51 of FIG. 7. Thus, the funnel 78 is formed of a porous material similar to the material forming the funnel 55 and is supplied with a compressed air from a pump 83 via a conduit 77 under control of a valve 82. The air thus supplied to the funnel 78 is injected into the magnetic toners in the hopper 74 similarly to the toner feeding apparatus of FIG. 7.

In the present embodiment, the magnetic toners are ejected from the funnel 78 through an outlet 75 into a container 70 held on a stage 71 that is movable up and down by a lifting mechanism 71A as indicated by arrows in FIG. 10. Thereby, the container 70 forms an air-tight enclosure except for an opening 72 and an opening 73, wherein the outlet 75 of the funnel 78 is inserted into the opening 72 when the stage 71 is lifted in the upward direction by the lift mechanism 71A toward the toner feeding apparatus. Thereby, the opening 72 forms an air-tight gasket with the outlet 75.

Further, there is provided a suction rod 76 adjacent to the toner feed apparatus, such that the suction rod 76 is inserted into the container 70 through the opening 73, wherein the suction rod 76 has an end connected to a suction pump 80 via a valve 81. The other end of the rod 76 is provided with a mesh filter 87 that allows suction of the air from the magnetic toners accumulated in the container 70. Thereby, the opening 73 forms a gasket with the suction rod 76. When the stage 71 is lowered, the suction rod 76 is disengaged from the container 70. It should be noted the various other filters such as a porous metal filter formed of sintered metal particles, a paper filter, a cloth filter, a non-woven fabric filter, and the like may be used for the filter 87. Typically, the openings 72 and 73 are formed to have a diameter of 6 mm or less, preferably 5 mm or less for reducing the size of the container 70, particularly when the container 70 is a toner cartridge.

In order to control the toner feeding rate including on- and off-control of the toners through the outlet 75, the toner feeding apparatus of FIG. 10 includes the control rod 52 similarly to the one shown in FIG. 7, wherein the control rod 52 includes the magnet 61 explained with reference to FIG. 7. Preferably, the magnet 61 is an electromagnet that is energized when shutting down the feeding of the toners and deenergized when carrying out feeding of the toners. Upon energization of the magnet 61 in the state that the control rod 52 is lowered and the magnet 61 is lowered also to a position located in the vicinity of the outlet 75 (see FIG. 8 described with reference to the previous embodiment), the toners attracted to the tip end part of the control rod 52 by the magnetic attraction of the electromagnet 61 prevent the flow of the toners from the hopper 74 to the container 70 through the toner outlet 75. It should be noted, however, that the tip end of the control rod 52 does not engage with the bottom part of the porous funnel 78 where the toner outlet 75 is formed even when the control rod 52 is fully lowered, and problems such as the toners being crushed to form flakes are positively eliminated. Further, as the magnet 61 itself is not exposed to the magnetic toners, the toners separate easily from the control rod 52 upon deenergization of the magnet 61.

In operation, the pump 83 supplies the compressed air to the funnel 78 via the valve 82 for injection into the magnetic toners in the hopper 74, and the toners in the hopper 74 are caused to flow into the container 70 through the outlet 75 with increased fluidity. Simultaneously, the suction pump 80 is activated, and the air in the toners in the container 70 is removed via the valve 81. By pumping out the air from the air-tight container 70, it is possible to increase the rate and hence the efficiency of toner feeding. Further, the flow rate of the toners is controlled by controlling the position of the control rod 52 as well as the position of the electromagnet 61 in the control rod and further by controlling the energization of the electromagnet 61.

The magnetic toners thus accumulated in the container 70 while pumping out the air therefrom, generally shows an increased bulk density as compared with the case in which the toners are deposited by a natural process. In order to avoid excessive increase of the bulk density of the toners, which may lead to a solidification of the toners by the bridging of the particles, the pump 80 or the valve 81 is controlled such that the air is pumped out from the container 70 with a negative pressure of −600—50 mmHg, preferably in the range of −250—150 mmHg. Further, in order to avoid solidification of the toners at the bottom part of the container 70, the suction rod 76 may be pulled up gradually as indicated in FIG. 10 by an arrow A, with the accumulation of the toners in the container 70, such that the suction of the air occurs only at the surface part of the toners accumulated in the container 70. Thereby, toners are obtained in the container 70 with a bulk density corresponding to the bulk density of the toners deposited by a natural process.

It is also possible to increase the toner bulk density in the container 70 by adjusting the suction pressure of the pump 80. In the case of the iron-based toners, it is possible to increase the weight of the toners per unit volume to 0.7–0.8 g/ml without problem, although depending upon the true density of the individual toner powders. By increasing the bulk density of the toners, it is possible to reduce the size of the toner cartridge or to increase the duration of operation of copier or printer without replacing the toner cartridge.

Figure 11:
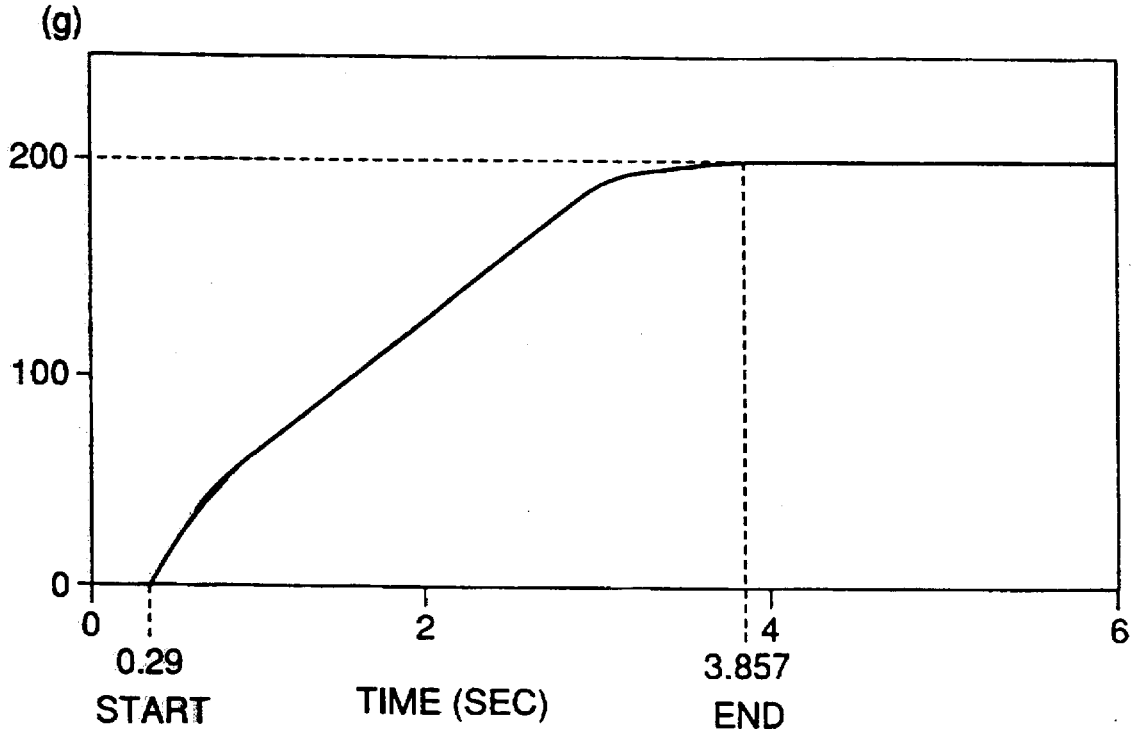
FIG. 11 is a diagram showing the characteristics of the powder feed apparatus of FIG. 10.

FIG. 11 shows the operational characteristics of the toner feeding apparatus of FIG. 10 for the case of filling the toners into a toner cartridge with an amount of 200 g, wherein the vertical axis indicates the total amount of the toners fed to the container 70 while the horizontal axis indicates the time.

Referring to FIG. 11, it will be noted that the ejection of the toners from the outlet 75 starts after 0.29 seconds upon deenergization of the magnet 61 in the control rod 52. After 3.857 seconds, it will be noted that the amount of the toners in the container reaches 200 g. In other words, the toner feeding apparatus of the present embodiment reduces the time needed for filling a toner cartridge by toners substantially.

It is also possible to apply the negative pressure to the container 20 intermittently, with a pause intervening between a suction and a next suction. Further, it is possible to open the valves 31 and 32 alternately, such that the injection of the air into the toners in the hopper 74 and the suction of the air from the toners in the container 70 occurs alternately. In this case, both the injection of the air into the hopper 74 and the suction of the air from the container 70 occurs intermittently.

After the filling of the toners into the container 70 is thus completed, the lift mechanism 71A is activated and the stage 71 is lowered. As a result, the outlet 75 as well as the suction rod 76 are disengaged from the respective openings 72 and 73, and the openings 72 and 73 are closed. When disengaging the outlet 75 and the suction rod 76 from the container 70, it should be noted that the problem of toner spillage does not occur, as the filter 87 has a diameter substantially identical to the diameter of the suction rod 76.

In the apparatus of FIG. 10, it should be noted that the valves 82 and 81 may be set to as to supply the compressed air from the pump 83 to the filter 87, in the event the toners in the container 70 have caused a solidification at the filter 87. By doing so, bridging of the toner particles or any clogging of the filter is successfully eliminated.

It should be noted that the toner feeding apparatus of the present invention is applicable not only to toners but also for feeding other magnetic powders.

Further, the present invention is not limited to the embodiments described heretofore, but various variations and modifications may be made without departing from the scope of the invention.

What is claimed is:

1. An apparatus for feeding a powder material into a container with a predetermined, controlled amount, comprising:

a hopper for holding a powder material therein, said hopper having a bottom part forming a funnel, said funnel including a porous wall for injecting a gaseous medium into said powder material therethrough, said funnel terminating in a downward directed outlet hole for ejecting said powder material to a container together with said gaseous medium;

a control rod provided in said hopper in alignment with said outlet hole in a manner movable in a vertical, axial direction thereof, said control rod controlling a flowrate of said powder material through said outlet hole; and a supplying system for supplying said gaseous medium into said porous wall;

said supplying system including a controller for controlling a supply of said gaseous medium such that said gaseous medium is injected intermittently, while filling said container, with a pause intervening between a gaseous medium injection and a next gaseous medium injection.

2. An apparatus as claimed in claim 1, wherein said apparatus further includes a suction pipe adapted for insertion into said powder material in said container, and a negative pressure source connected to said suction pipe for evacuating said gaseous medium from said powder material, said suction pipe being movable in a vertical direction.

3. An apparatus as claimed in claim 1, wherein said control rod includes a magnet provided movably in said control rod in said axial direction.

4. An apparatus as claimed in claim 1, wherein said porous wall of said funnel includes pores having an average diameter in a range between 2–75 μm.

5. An apparatus as claimed in claim 4, wherein said pores have an average diameter in a range between 20–50 μm.

6. An apparatus as claimed in claim 1, wherein said porous wall of said funnel comprises a sintered material formed of particles having a diameter of 20–50 μm.

7. An apparatus as claimed in claim 1, wherein said porous wall of said funnel comprises a non-magnetic material.

8. A method for feeding a powder material into a container with a predetermined, controlled amount, comprising the steps of:

injecting a gaseous medium into a powder material held in a hopper having a bottom outlet hole, for ejecting said powder material therefrom into a container together with said gaseous medium;

said step of injecting said gaseous medium comprises the step of injecting said gaseous medium through a porous wall of a funnel provided at a bottom part of said hopper;

evacuating said gaseous medium from said powder material accumulated in said container, said step of evacuating said gaseous medium is conducted intermittently while filling said container.

9. A method as claimed in claim 8, wherein said step of evacuating said gaseous medium is conducted by inserting a pipe into said powder material accumulated in said container, said pipe having an inlet at a first end thereof for evacuating said gaseous medium therethrough, said pipe being pulled up with a progress of accumulation of said powder material in said container, such that said first end of said pipe moves in an upward direction with the progress of accumulation of said powder material.

10. A method for feeding a powder material into a container with a predetermined, controlled amount, comprising the steps of:

injecting a gaseous medium into a powder material held in a hopper terminating in a bottom downward directed outlet hole, for ejecting said powder material therefrom into a container together with said gaseous medium:

said step of injecting said gaseous medium comprises the step of injecting said gaseous medium through a porous wall of a funnel provided at a bottom part of said hopper; and controlling a feed rate of said powder material supplied to said container through said outlet hole, by moving a control rod, provided in said hopper in alignment with said outlet hole with respect to said outlet hole.

11. A method as claimed in claim 10, wherein said control step includes a step for positioning an end of said control rod such that said outlet hole is closed by said control rod.

12. A method as claimed in claim 10, wherein said control step includes a step for energizing a magnet in said hopper in the vicinity of said outlet hole.

13. A method as claimed in claim 12, wherein said control step further includes a step of moving said magnet in a vertical direction in a control rod provided in said hopper in alignment with said outlet hole.

14. A method for feeding a powder material into a container with a predetermined, controlled amount, comprising the steps of:

injecting a gaseous medium into a powder material held in a hopper having a bottom outlet hole, for ejecting said powder material therefrom into a container together with said gaseous medium;

said step of injecting said gaseous medium comprises the step of injecting said gaseous medium through a porous wall of a funnel provided at a bottom part of said hopper, wherein said powder material comprises a toner, and wherein said container comprises a toner cartridge.

15. A method as claimed in claim 14, wherein said toner comprises a magnetic toner.

16. A method for feeding magnetic toners into a toner cartridge with a predetermined, controlled amount, comprising the steps of:

injecting a gaseous medium into toners held in a hopper having a bottom outlet hole, for ejecting said toners therefrom into a toner cartridge together with said gaseous medium;

said step of injecting said gaseous medium comprises the step of injecting said gaseous medium through a porous wall of a funnel provided at a bottom part of said hopper; and controlling a flowrate of said toners supplied to said toner cartridge through said outlet hole;

wherein said controlling step includes a step for energizing a magnet in said hopper in the vicinity of said outlet hole.

17. A method as claimed in claim 16, wherein said control step further includes a step of moving said magnet in a vertical direction in a control rod provided in said hopper in alignment with said outlet hole.

18. A method as claimed in claim 17, wherein said control step further includes a step of moving said control rod vertically in an axial direction thereof.

19. A method as claimed in claim 16, wherein said step of injecting the gaseous medium is carried out a plurality of times intermittently while filling said toner cartridge, with a pause of gaseous medium injection intervening between a gaseous medium injection and a next gaseous medium injection.

20. A method as claimed in claim 16, wherein said method further comprising the step of evacuating said gaseous medium from said toners accumulated in said toner cartridge.

21. A method as claimed in claim 20, wherein said step of evacuating said gaseous medium is conducted intermittently while filling said toner cartridge.

22. A method as claimed in claim 20, wherein said step of evacuating said gaseous medium is conducted by inserting a pipe into said toners accumulated in said toner cartridge, said pipe having an inlet at a first end thereof for evacuating said gaseous medium therethrough, said pipe being pulled up with a progress of accumulation of said toners in said toner cartridge, such that said first end of said pipe moves in an upward direction with the progress of accumulation of said toners.

23. A method as claimed in claim 16, wherein said step of injecting said gaseous medium is conducted through a porous inner wall of said hopper located above said funnel.

* * * * *